US007127920B1

(12) United States Patent
Su

(10) Patent No.: US 7,127,920 B1
(45) Date of Patent: Oct. 31, 2006

(54) KNITTING MACHINE FOR MANUFACTURING PLUSH FABRICS

(75) Inventor: Po-Hao Su, Taipei Hsien (TW)

(73) Assignee: Pai Lung Machinery Mill Co., Ltd, Taipei Hsien (TW)

( * ) Notice: Subject to any disclaimer, the term of this patent is extended or adjusted under 35 U.S.C. 154(b) by 0 days.

(21) Appl. No.: 11/280,388

(22) Filed: Nov. 17, 2005

(51) Int. Cl.
*D04B 9/12* (2006.01)

(52) U.S. Cl. ..... 66/92

(58) Field of Classification Search ..... 66/9 R, 66/190, 191, 194, 19, 27, 54, 55
See application file for complete search history.

(56) References Cited

U.S. PATENT DOCUMENTS 3,041,859 A * 7/1962 Lie et al. ..... 66/92
3,094,944 A 6/1963 Bradt et al.
4,127,013 A * 11/1978 Nuber ..... 66/92
4,592,212 A * 6/1986 Schmidt ..... 66/91
5,463,882 A 11/1995 Yeh
6,128,930 A 10/2000 Schmidt
6,735,987 B1 5/2004 Plath et al.

* cited by examiner

*Primary Examiner*—Danny Worrell
(74) *Attorney, Agent, or Firm*—Birch Stewart Kolasch & Birch, LLP

(57) ABSTRACT

A knitting machine for manufacturing plush fabrics includes latch-less cylinder needles in a cylinder, latch needles located on a needle dial and a cutting unit. The loop formed by a plush thread can be directly knitted in a fabric formed by ground threads to form a longer plush on the fabric surface. By changing the dimension of the needle dial, the interval of the peripheral edge of the needle dial and the cylinder needle can be increased so that the plush thread held on the hook of the cylinder needle can be stretched by the latch needle to become a longer loop. Finally, the loop is severed by the cutting unit to form a plush fabric of a longer plush.

3 Claims, 7 Drawing Sheets

KNITTING MACHINE FOR MANUFACTURING PLUSH FABRICS

FIELD OF THE INVENTION

The present invention relates to a circular knitting machine and particularly to a knitting machine for manufacturing plush fabrics with a longer plush.

BACKGROUND OF THE INVENTION

Plush fabrics are generally produced by knitting machines, also called artificial wool knitting machines. The techniques of using circular knitting machines to produce plush fabrics are known in the art. For instance, U.S. Pat. No. 6,735,987 has latch needles located in a cylinder and a plurality of sinkers located horizontally on a needle dial that interact with each other to hold a plush thread on the front edge of the sinkers to form a longer loop.

U.S. Pat. Nos. 6,128,930, 6,094,944 and 5,463,882 basically include latch-less cylinder needles located in a cylinder, latch needles located on a needle dial and a cutting unit that interact to produce plush fabrics. The loop is formed on the hook of the latch-less cylinder needle, and is severed by two sinkers that have a blade on the front side and slide on two sides of the cylinder needle to form the plush.

In the U.S. Pat. Nos. 6,128,930 and 5,463,882, the length of the plush is determined by the interval of the hook of the cylinder needle and the edge of the needle dial. In general, the plush fabrics produced by such techniques have plush length about 3 mm. To make toys and puppets with the artificial furs or pelts, the plush length of 3 mm cannot create a real-like appealing look. To increase the plush length, the interval of the hook of the cylinder needle and needle dial edge must be greater. This may be accomplished by increasing the diameter of the cylinder. Then the sinker ring to hold the blade on the periphery of the cylinder also must have a greater diameter. As a result, the relative position and the dimensions of the blades and cylinder needles have to be changed. It will result in a greater gap between the blade and the cylinder needle and make severing of the loop difficult or impossible.

SUMMARY OF THE INVENTION

Therefore the primary object of the present invention is to provide a knitting machine for manufacturing plush fabrics, and especially a plush knitting machine for producing plush at a length up to 12 mm.

According to an embodiment of the invention, the plush knitting machine includes latch-less cylinder needles located in a cylinder, latch needles located horizontally on a needle dial and a cutting unit. The interval of the peripheral edge of the needle dial and the cylinder needles can be increased by changing the dimension of the needle dial. The plush thread forms a loop on the hook of the latch-less cylinder needle, then the latch needle on the needle dial pulls the plush thread to form a longer loop. Finally the cutting unit severs the loop to form a plush fabric with a longer plush.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
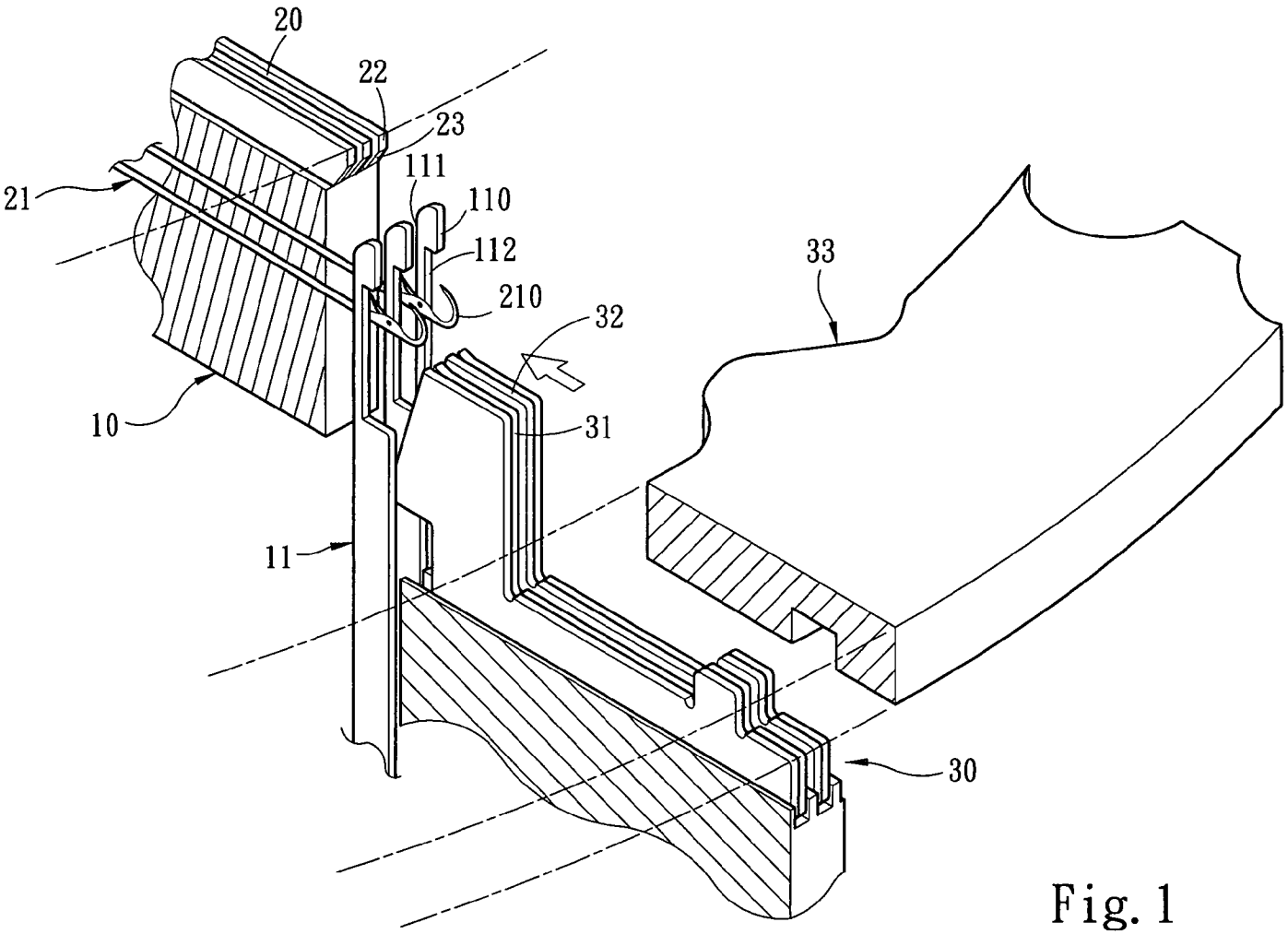
FIG. 1 is a schematic view of an embodiment of the present invention.
Figure 2:
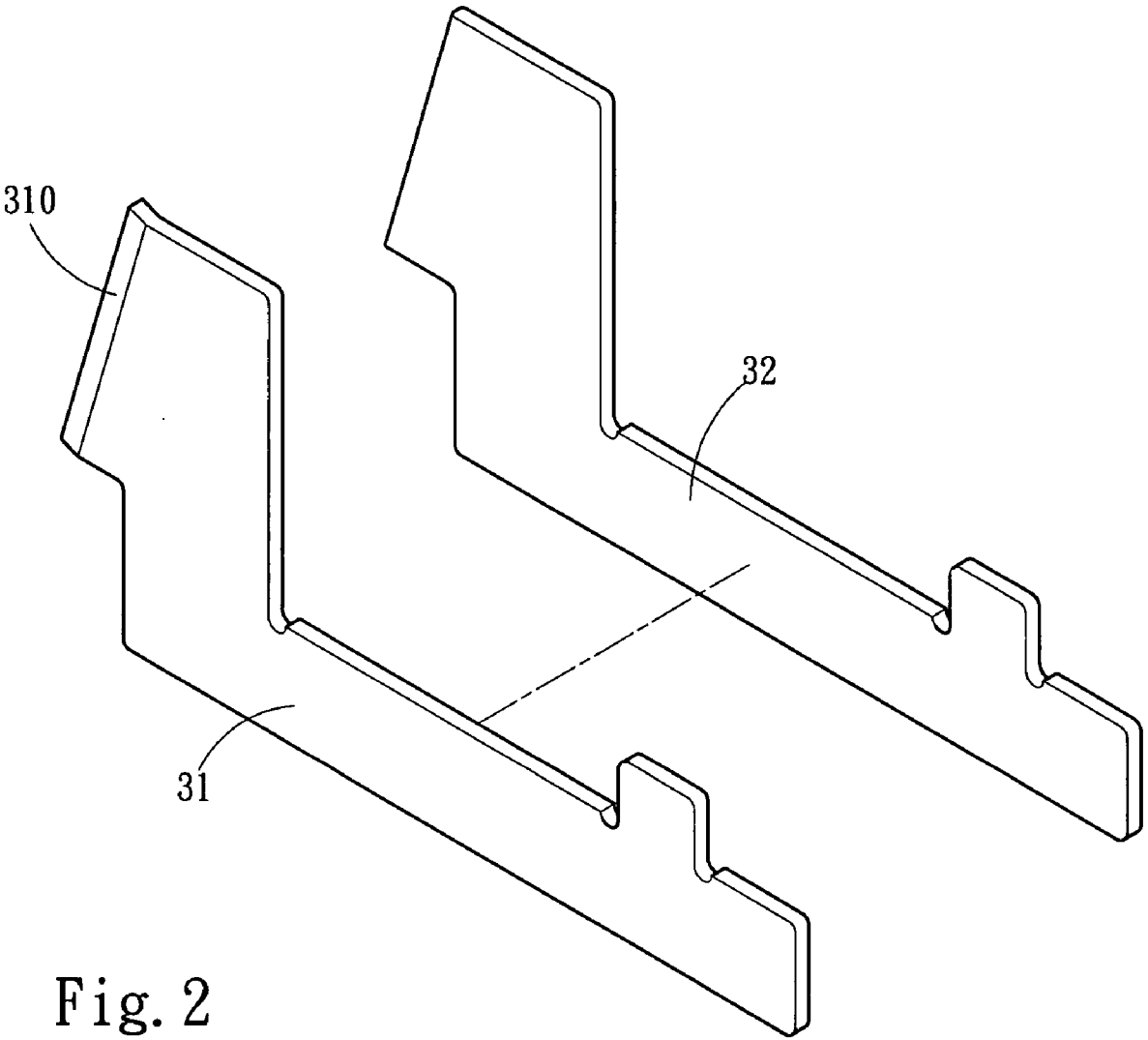
FIG. 2 is a schematic view of an embodiment of the cutting unit of the present invention.
Figure 3:
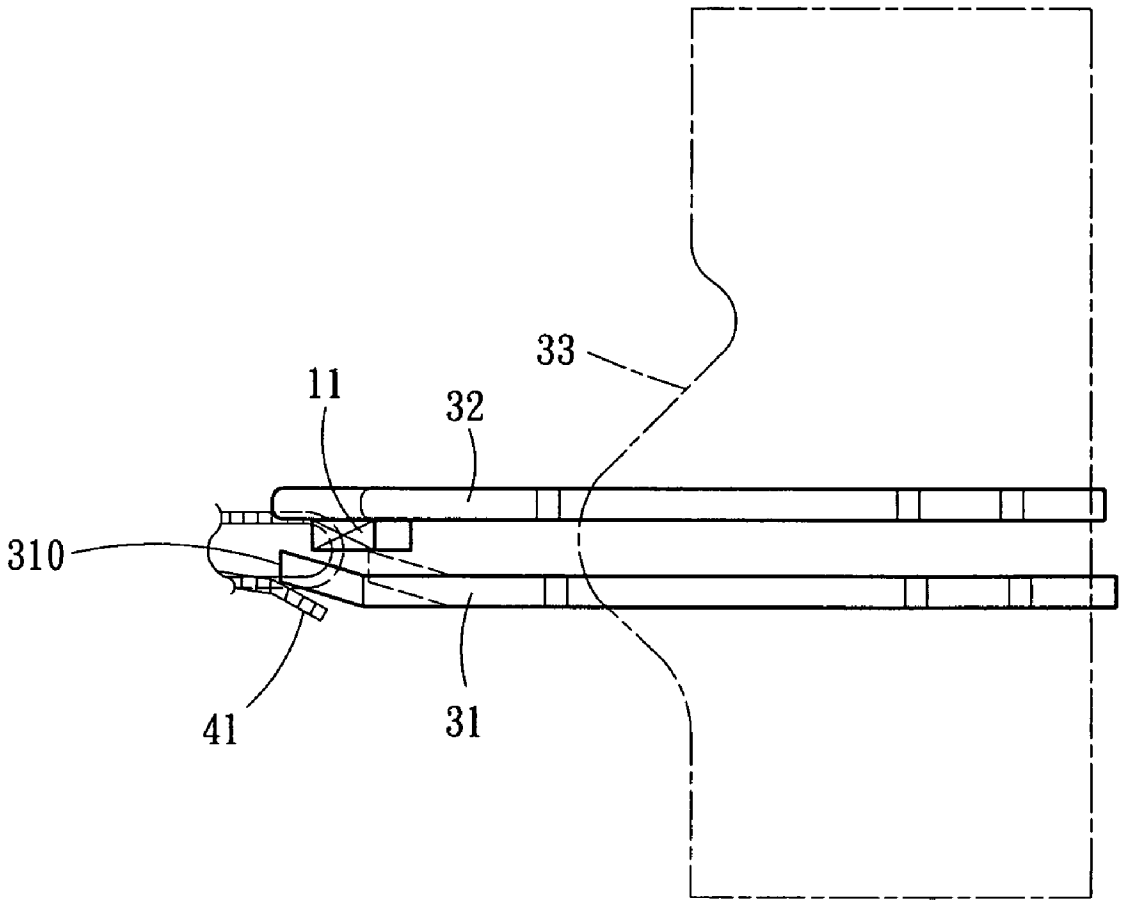
FIG. 3 is a schematic view of the present invention showing the cutting unit severing a loop to form a plush.
Figure 4:
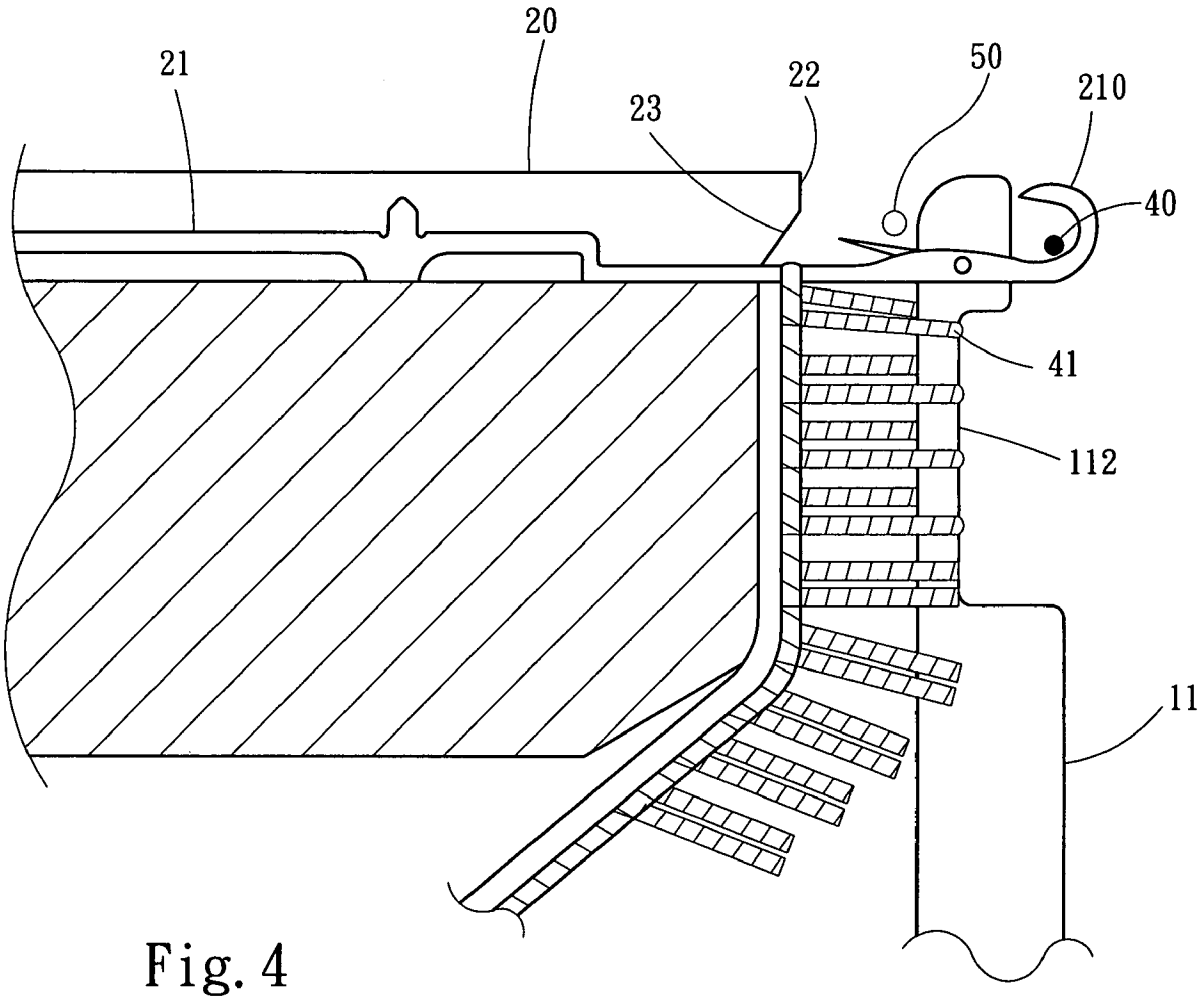
FIGS. 4 through 7 are operation flow according to an embodiment of the invention to produce plush fabrics.
Figure 5:
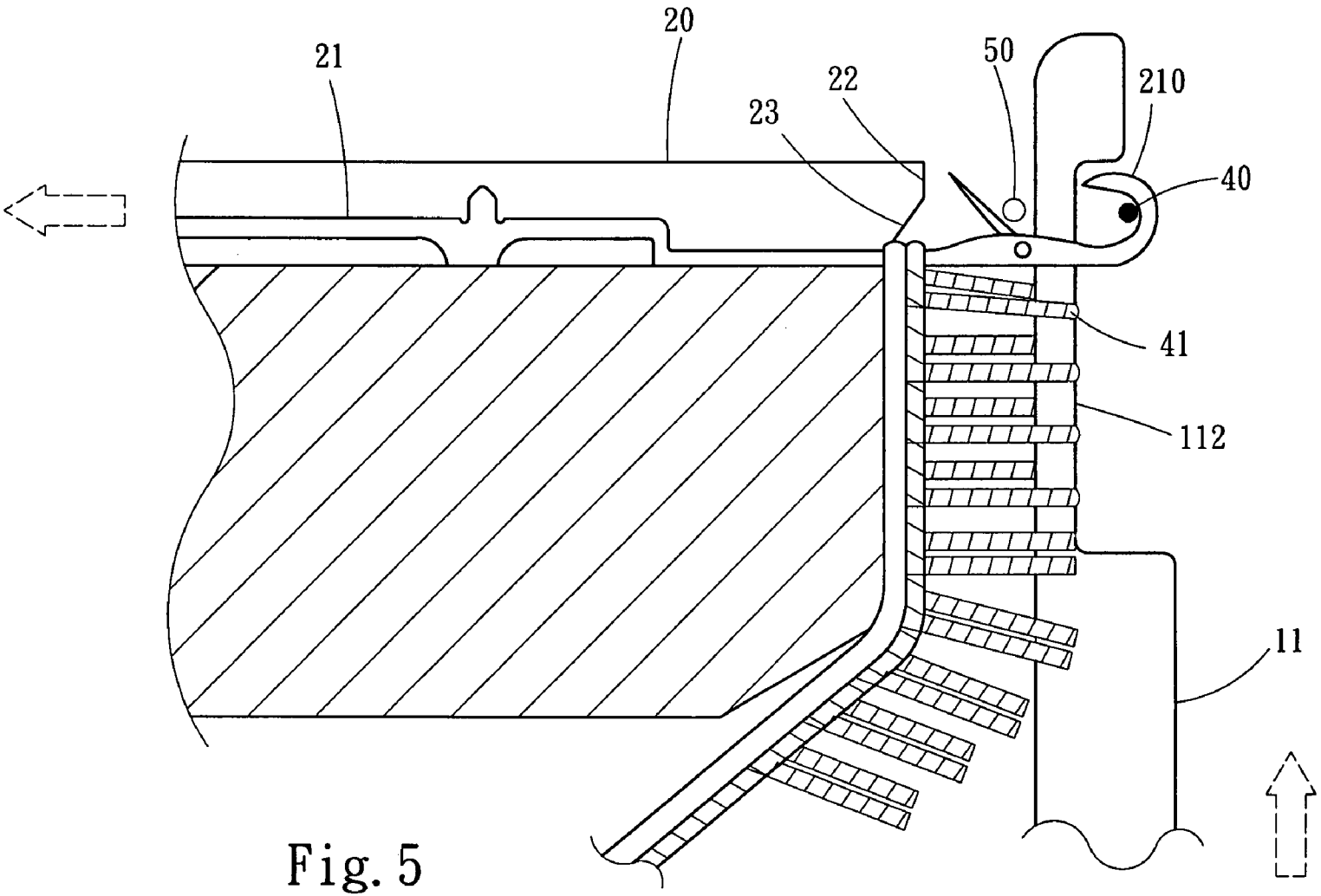
Figure 6:
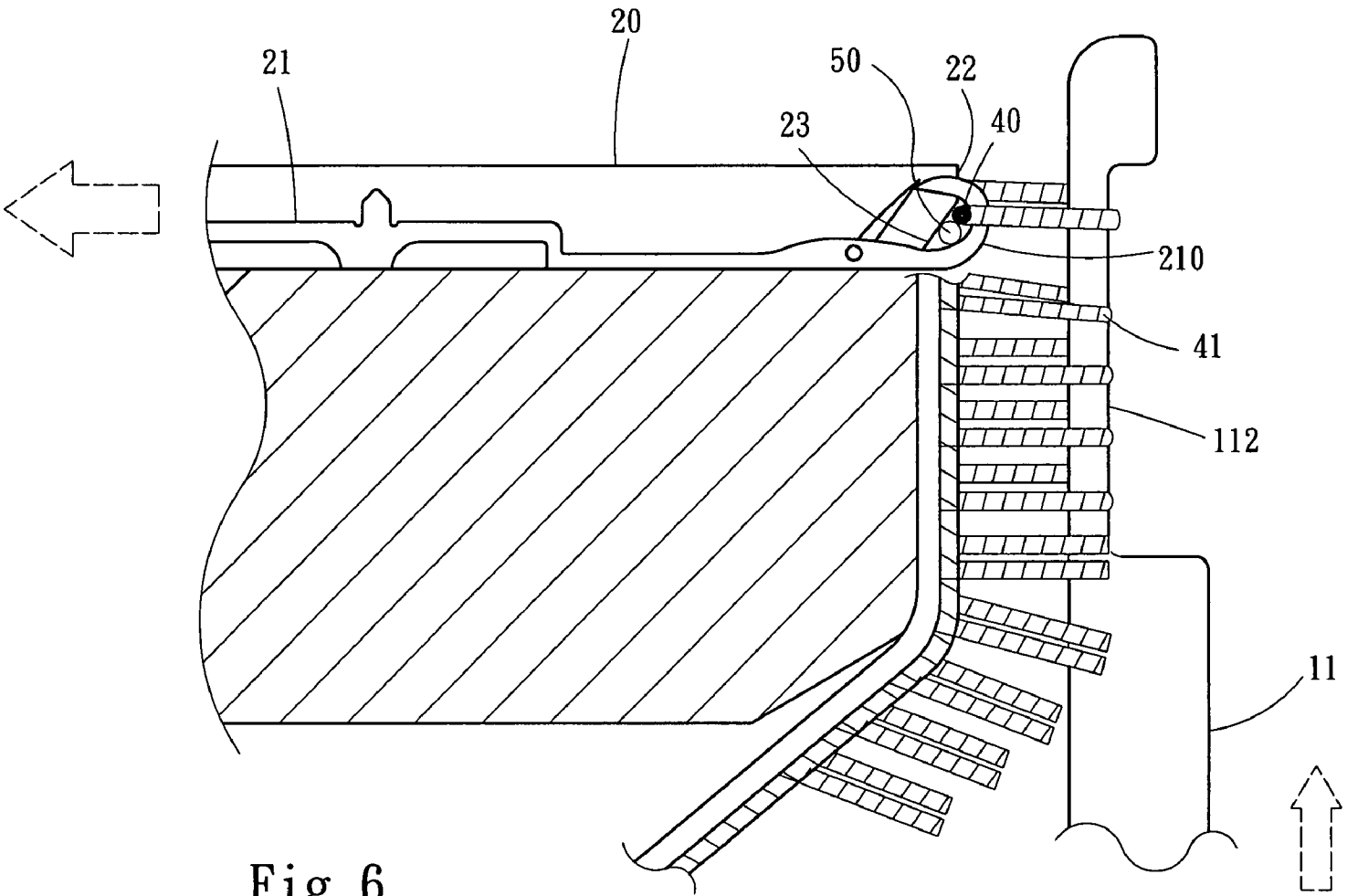
Figure 7:
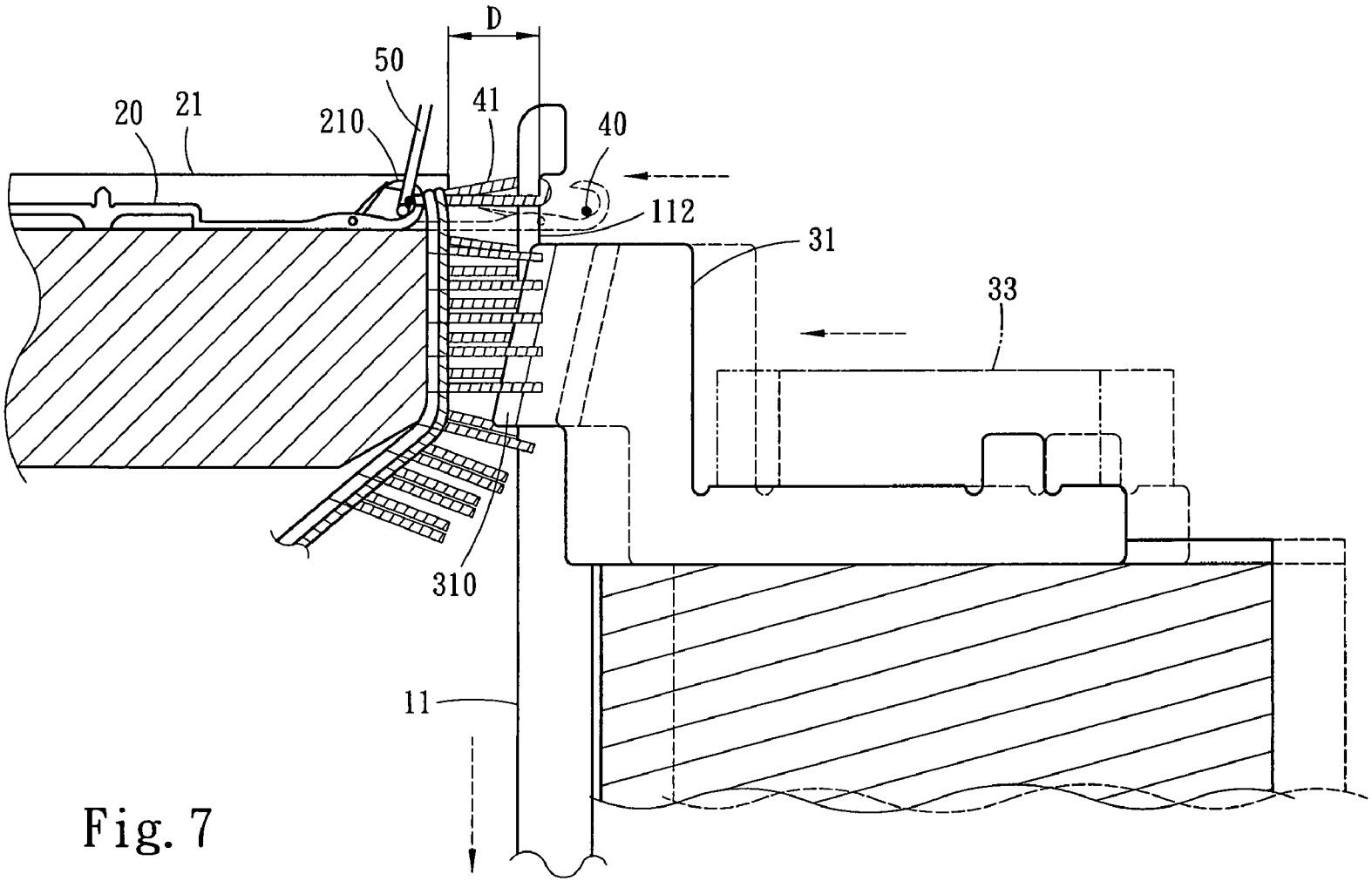

Please referring to FIG. 1, the circular knitting machine has a knitting unit to produce plush fabrics, namely to transform threads to fabrics. The embodiment of the invention includes:

Latch-less cylinder needles 11 located in a cylinder 10, latch needles 21 located on a needle dial 20 and a cutting unit 30. The cutting unit 30 includes two sinkers 31 and 32 formed in one set (referring to FIG. 2) and a cam 33. The sinkers 31 and 32 are driven by the cam 33 to slide on two sides of each cylinder needle 11 at the same time. The sinker 31 has a blade 310 which can sever a loop 41 formed by a plush thread 40 to become lengthy plush (referring to FIG. 3).

According to the embodiment, the dimension of the needle dial 20 may be changed so that the interval D of the needle dial peripheral edge 22 and a first hook 112 of the cylinder needle can be increased to 10–15 mm. Hence the plush thread 40 held on the first hook 112 can be pulled by the latch needle 21 to form a longer loop 41. Finally, the cutting unit 30 severs the loop 41 to form a plush fabric with the plush length up to about 12 mm.

Refer to FIGS. 4 through 7 for the manufacturing process for producing the plush. First, the plush thread 40 is fed between a front edge 110 of a cylinder needle and a second hook 210 of a latch needle, and a ground thread 50 is fed between a rear end 111 and the needle dial peripheral edge 22 (referring to FIG. 4); while the latch needle 21 is moved leftwards (referring to FIG. 5) and retracted, the cylinder needle 11 starts to move upwards so that the first hook 112 is raised to an elevation where the plush thread 40 can be picked up; the plush thread 40 is latched by the second hook 210 of the latch needle and held on the first hook 112 of the cylinder needle to form the loop 41; the latch needle 21 is retracted continuously to pick up the ground thread 50 and carry it to a sloped side 23; guided by the sloped side 23, the latch needle is moved gradually beneath the second hook 210; then the ground thread 50 is moved below the plush thread 40 (referring to FIG. 6); thereafter the cylinder needle 11 is moved downward to stretch the loop 41 through the first hook 112. Thus through the interactions of the cylinder needle 11 and the latch needle 21, the loop 41 formed by the plush thread 40 can be directly knitted in the fabric formed by the ground thread 50. Finally the loop 41 can be severed by the cutting unit 30 to form the plush fabric with a longer plush.

What is claimed is:

1. A knitting machine for manufacturing plush fabrics, comprising latch-less cylinder needles in a cylinder, latch needles located on a needle dial and a cutting unit;

wherein a plush thread is held on a hook of each latch-less cylinder needle and stretched by one latch needle to form a longer loop, the longer loop being severed by the cutting unit to form a plush fabric having a longer plush;

wherein the needle dial has a peripheral edge which is spaced form the hook of the cylinder needle at an interval of 10–15 mm to allow the plush thread to form the longer loop.

2. The knitting machine of claim 1, wherein the plush formed by severing of the loop has a length of 12 mm.

3. The knitting machine of claim 1, further including means for adjusting spacing between the hook of the cylinder needle and the peripheral edge of the needle dial.

* * * * *